United States Patent [19]

Tachibana

[11] Patent Number: 4,949,636

[45] Date of Patent: Aug. 21, 1990

[54] SCREEN PRINTING MACHINE

[75] Inventor: Itaru Tachibana, Tokyo, Japan

[73] Assignee: New Long Seimitsu Kogyo Co., Ltd., Tokyo, Japan

[21] Appl. No.: 235,302

[22] Filed: Aug. 23, 1988

[30] Foreign Application Priority Data

Sep. 17, 1987 [JP] Japan ..... 62-140871[U]

[51] Int. Cl.[5] ..... B05C 17/06

[52] U.S. Cl. ..... 101/123; 101/121

[58] Field of Search ..... 101/116, 121, 122, 35, 101/41, 44, 123, 124, 4, 9, 10, 11; 211/169.1, 170, 173, 174

[56] References Cited

U.S. PATENT DOCUMENTS

| | | | |
|---|---|---|---|
| 1,284,031 | 11/1918 | Ahlburg | 101/35 |
| 1,369,570 | 2/1921 | Stiles | 101/35 |
| 4,173,185 | 11/1979 | Voegelin | 101/124 X |
| 4,226,209 | 10/1980 | Kenworthy | 101/125 X |
| 4,240,343 | 12/1980 | Monvoisin | 101/129 X |
| 4,245,554 | 1/1981 | Kammann et al. | 101/124 |
| 4,365,551 | 12/1980 | Horton | 101/124 |
| 4,376,412 | 3/1983 | Nagatani | 101/124 |

FOREIGN PATENT DOCUMENTS

| | | | |
|---|---|---|---|
| 1034659 | 7/1958 | Fed. Rep. of Germany | 101/123 |

*Primary Examiner*—Edgar S. Burr
*Assistant Examiner*—Motilal P. Patel
*Attorney, Agent, or Firm*—Wenderoth, Lind & Ponack

[57] ABSTRACT

A screen printing machine includes a lifting block liftably provided relative to a movable block. The movable block is reciprocatingly movable in a horizontal direction above a screen disposed on an article to be printed. A printing member includes at least one of a scraper and a skid mounted to the lifting block to facilitate screen printing by extruding ink on the screen. Mounting structure pivotally supports the lifting block so as to be displaceable in a widthwise direction of the lifting block so that the printing member can automatically follow the upper surface of the screen even though it is inclined.

2 Claims, 4 Drawing Sheets

SCREEN PRINTING MACHINE

BACKGROUND OF THE INVENTION

A screen printing machine has been used for printing predetermined characters and/or designs onto a printed article such as a sheet, a plate and a box-like member composed of paper, synthetic resin, ceramic, glass or metal. Such a screen printing machine comprises a screen disposed on the printed article, a printing member such as a skid slid along the screen in a pressurized manner during printing and then disengaged from the screen, and a scraper moved along the screen together with the skid to scrape ink. The scraper serves to coat the screen with ink from the end of the screen where the printing begins, while the skid slides on the screen in a pressurized manner from the end of the screen the printing begins, to the end of the screen where the printing terminates to print the article disposed under the screen.

It should be noted that the skid is required to forcibly engage the whole face of the screen in a uniform manner in a widthwise direction of the screen during printing so that an ink film having a uniform thickness is coated over the entire surface of the article to be printed.

The prior art machine comprises means to support the skid as shown in FIG. 5 to meet the aforementioned requirement. A screen 1 is forced onto a surface of an article 2 to be printed such as a sheet-like member and skid 3 disposed on the screen 1 in a liftable manner forcibly engages the screen 1 during printing. The skid 3 is supported in a liftable manner by and below a moveable plate 5 which is in turn slidably supported through sliders 5*a*, 5*a* by a pair of shafts 4, 4 provided above the screen 1 and extending in the printing direction. More particularly, a liftable plate 6 of a lifting block having the skid 3 provided thereon is liftably supported on the moveable plate 5 through a pair of guiding bearings 7*a* (only one of which is shown in FIG. 5). The liftable plate 6 is connected through a metal joint 8*b* to a piston rod 8*a* of an air cylinder 8 which constitutes means to liftably drive the liftable plate 6. The air cylinder 8 is mounted on the movable plate 5. Thus, it will be noted that the liftable plate 6 can be lifted and lowered by the air cylinder 8. A slider mounting holder 6*a* is provided on the liftable plate 6 and the skid 3 is connected to and supported by the slider mounting holder 6*a* through a supporting pin 3*a* so as to be swingable. A pair of adjusting screws 9, 9 threaded through the movable plate 5 are provided on both sides of the slider mounter holder 6*a* and engage the right and left ends of the skid 3 to swing the skid about the supporting pin 3*a*.

The pair of adjusting screws 9, 9 are alternately adjusted so that the sliding edge 3*b* of the skid 3 engages the surface of the article 2 to be printed on a table (not shown) in a horizontal manner. It should be noted that this adjustment has to be made so that the right and left sides of the skid are balanced while the gap between the sliding edge 3*b* of the skid and the table is observed or while the gap is measured by a pulling force detected by a gap gauge interposed therebetween.

However, it will be understood that the operation of adjusting the skid 3 so that the sliding edge 3*b* is oriented parallel to the table (the surface of the acticle to be printed) is very troublesome, which means the operation requires a high skilled operator and a large amount of time. This required time for setting the skid 3 contributes to a low efficiency in the operation of the screen printing machine. Furthermore, it is often difficult to obtain a complete parallelism of the skid even though the adjustment is made. Also, even though the skid 3 is kept parallel to the surface of the article to be printed, the skid is locked to the slider mounting holder 6*a* after the adjustment thereof. Thus, it will be noted that a uniform forcible engagement of the skid 3 with the screen cannot be obtained if a variation in the thickness of the article 2 occurs or curvature thereto develops. Thus, a uniformly forcible engagement of the skid with the screen cannot be obtained and an ink film having a uniform thickness cannot be provided on the surface of the article to be printed.

Furthermore, if the printing is carried out while the skid is not maintained parallel to the surface of the article to be printed, only one of the sides of the sliding edge 3*b* engages the screen 1 or one side of the sliding edge 3*b* forcibly engages the screen under a high printing pressure that is beyond the required value thereof, which disadvantageously reduces the printing accuracy.

Even in a screen printing machine in which a lifting block having the skid 3 mounted thereon is swingingly supported on the movable plate 5 so that the skid 3 can follow the inclination of the surface of the article to be printed, when only one side of the sliding edge 3*b* engages the screen 1 friction will be generated so that the skid 3 will not be able to slide laterally or so that the skid 3 will slide laterally with some time lag after the skid 3 begins to slide. Thus, it will be noted that even such a screen printing machine cannot print the article in a uniform manner and tends to produce the lateral sliding movement of the screen 1 when skid 3 slides laterally.

It will be understood that similar problems will also occur during the lowering operation of the scraper (not shown) which is supported on the movable plate 5 beside the skid 3 and is raised and lowered with the skid 3.

SUMMARY OF THE INVENTION

Accordingly, it is a prinicipal object of the invention to provide a screen printing machine in which a skid is adapted to effectively follow a surface of an article to be printed even though the surface is inclined relative to the horizontal so that a uniform printing of the article surface can be accomplished.

It is another object of the invention to provide a screen printing machine in which a uniform printing of the article surface can be accomplished at a low expense, and having a relatively small number of parts.

It is further object of the invention to provide a screen printing machine in which a skid setting operation is not required due to an automatic setting of a skid relative to the article so that a highly efficient operation can be carried out.

In accordance with the present invention, there is provided a screen printing machine comprising a lifting block liftably provided relative to a movable block. The movable block is reciprocatingly movable in a horizontal direction above a screen disposed on an article to be printed. A printing member includes at least one of a scraper and a skid mounted to the lifting block to facilitate screen printing by extruding ink on said screen. Support means pivotally supports said lifting block so that said lifting block is displaceable in a widthwise direction of said lifting block whereby said printing member can automatically follows an upper surface of said screen.

Since the lifting block is lowered by lifting block drive means during printing so that a sliding edge of the skid forcibly engages the screen, the lifting block pivotally moves while it laterally slides in a widthwise direction of the lifting block so that the skid automatically follows the upper surface of the screen even though the surface of the article to be printed is inclined relative to the horizontal. Thus, it will be noted that the sliding edge of the skid forcibly engages the entire surface of the screen under uniform pressure so that accurate printing can be performed due to the generation of a uniform printing pressure.

BRIEF DESCRIPTION OF THE DRAWINGS

The above and other objects and features of the invention will be apparent from the description of an embodiment of the invention made with reference to the accompanying drawings in which.

DETAILED DESCRIPTION OF THE EMBODIMENT

Figure 1:
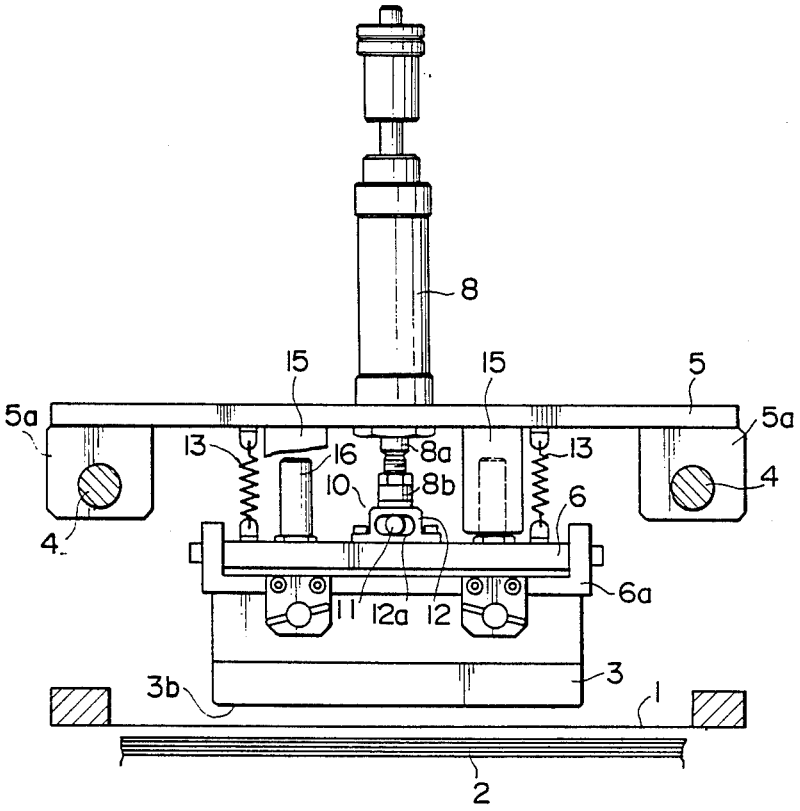
FIG. 1 is a front view of a screen printing machine having skid holding means in accordance with one embodiment of the invention.

Referring now to FIGS. 1 through 4 of the accompanying drawings, there is shown a screen printing machine having skid holding means in accordance with one embodiment of the invention.

A screen 1 is forced onto a surface of an article 2 to be printed such as a sheet-like member and a skid 3 is moved along the screen 1 in a liftable manner forcibly engaging the screen 1 during printing. The skid 3 is supported in a liftable manner by and below a movable plate 5 which is in turn slidably supported through sliders 5*a*, 5*a* by a pair of shafts 4, 4 provided above the screen 1 whereby skid 3 can be reciprocatingly moved horizontally along the printing direction. A liftable plate 6 of a lifting block having the skid 3 provided thereon is liftably supported on the movable plate 5 by lifting block drive means such as an air cylinder 8 which is connected to the liftable plate 6 through lifting supporting means 10. Lifting support means 10 swingably supports the liftable plate 6 as described below in detail. A pair of coil springs 13, 13 are provided between the movable plate 5 and the liftable plate 6 to suspend and hold the lifting block in a balanced manner in a widthwise or lateral direction. A skid holder 6*a* is mounted on the liftable plate 6 so as to be angularly adjustable from 90 degrees to 60 degrees relative to the screen 1 and so as to be stably raisable and lowerable relative to the screen 1. Two pairs of guiding plates 15, 15 are secured to the movable plate 5 and two guide blocks 16, 16 extending upwardly from the liftable plate 6 are slidably disposed between the respective pairs of guiding plates 15, 15 so that the guide blocks 16, 16 are slidably movable in vertical and horizontal directions.

Figure 4:
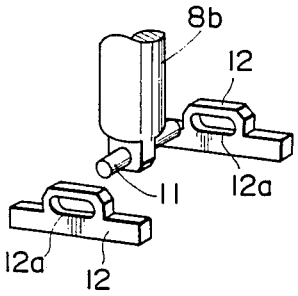
FIG. 4 is an exploded perspective view of lifting block supporting means of the invention.
Figure 5:
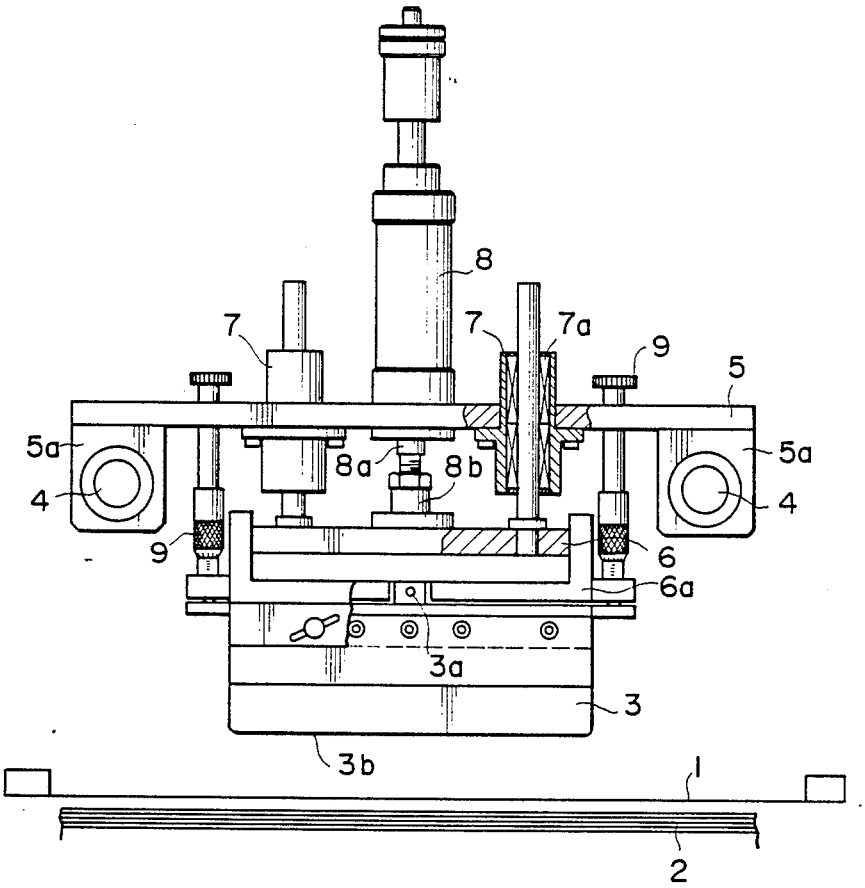
FIG. 5 illustrates a front view of a prior art screen printing machine.

Lifting block supporting means 10 swingingly supporting the lifting block or the liftable plate 6 is constructed to pivotally support the liftable plate 6 so that the liftable plate 6 is displaceable in a widthwise direction of the liftable plate 6 whereby the skid 3 as a printing member automatically follows an upper surface of the screen 1. In the illustrated embodiment, as shown in FIG. 4, the lifting block supporting means 10 swingingly supporting the lifting block comprises a supporting pin 11 secured to a lower end of a metal joint 8*b* which is in turn connected to a piston rod 8*a* of the air cylinder 8 so that the supporting pin 11 extends in forward and backward directions, and a bracket 12 provided on the liftable plate 6. The bracket 12 has an elongate groove 12*a* extending at an upper end of the bracket 12 in a widthwise direction of the liftable plate 6 and through which the supporting pin 11 extends. Thus, it will be noted that the liftable plate 6 can be pivotally moved about the supporting pin 11 while it is displaced in a widthwise direction of the skid 3.

Figure 2:
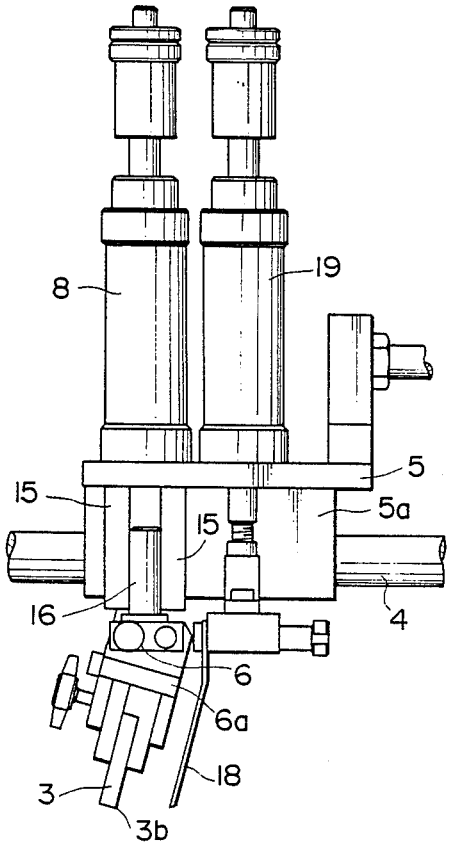
FIG. 2 is a side elevational view of the screen printing machine of FIG. 1.
Figure 3A:
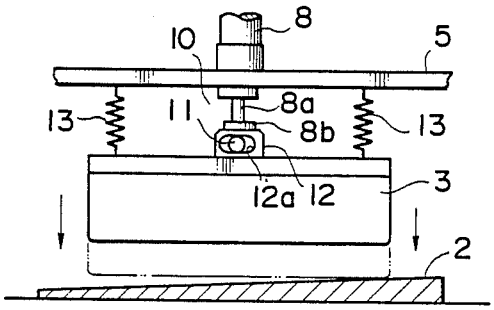
FIGS. 3A and 3B schematically illustrate the skid automatically moving so that it follows the upper surface of the screen.
Figure 3B:
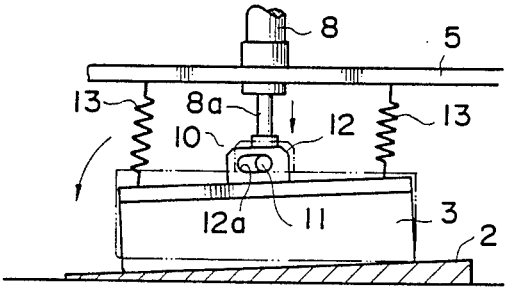

As noted from FIG. 2, a scraper 18 is provided to extrude and coat ink onto the screen 1 and is connected to an air cylinder 19 in the same manner as described with respect to the skid 3.

In operation, the lifting block including the skid 3 and liftable plate 6 is lowered by the air cylinder 8 to force the sliding edge 3*b* of the skid 3 into engagement with the surface of the article 2 to be printed through the screen 1. In this case, the skid 3 can automatically follow the surface of the printed article 2 even though it is inclined without any parallel adjustment of the skid 3 which is required for the prior art printing machine because the lifting block supporting means 10 including the supporting pin 11 and bracket 12 allows the skid 3 to swing and to be displaced or moved in a widthwise direction of the lifting block. Thus, it will be understood that the sliding edge 3*b* of the skid 3 forcibly engages the surface of the article 2 to be printed along the whole length of the sliding edge 3*b* under a uniform pressure. This enables the generation of a uniform printing pressure over the whole surface of the article 2 to be printed. More particularly, as apparent from FIGS. 3A and 3B, even though only one side of the skid 3 engages the screen 1 and never slides laterally due to the friction between them, the skid 3 swingingly moves about the one side of the skid 3 engaging the screen 1, which easily and simply allows the uniform forcible engagement of the skid 3 with the surface of the article 2 to be printed.

Although one preferred embodiment of the invention has been illustrated and described with reference to the accompanying drawings, it will be understood by those skilled in the art that such a description is by way of example, and that various changes and modifications may be made without departing from the spirit and scope of the invention. For example, it will be understood that the scraper may be supported in the same manner as described with respect to the skid 3. Furthermore, the lifting block drive means for the skid 3 and the scraper 18 are described as air cylinders, but may be any other drive means such as oil pressure cylinders or electric motors. In addition thereto, the lifting block supporting means 10 may be modified in various manners, including the reversal of the supporting pin 11 and the bracket 12 having the elongated groove 12*a* for example, or can comprise other components such as a combination of a ball and a plate engaging the ball. Furthermore, although in the illustrated embodiment the pair of coil springs 13, 13 are used for suspending the liftable plate 6 having the skid 3 provided thereon from the movable plate 5, the springs may be replaced by any other member such as leaf springs. In other words, this invention is intended to be defined only by the appended claims.

What is claimed is:

1. A screen printing machine for printing a surface of an article with a pattern defined on a screen disposed on the surface, said machine comprising:

a movable plate supported in the machine for reciprocal movement in a horizontal direction;

a lifting plate supported by said movable plate so as to move in the horizontal direction therewidth and so as to be raisable and lowerable relative thereto;

a printing member for speading ink over the surface of an article to be printed, said printing member comprising at least one of a skid and a scraper mounted to said movable plate so as to move therewidth;

mounting means mounting said lifting plate to said movable plate in a manner which allows said lifting plate to pivot relative to said movable plate and to move horizontally, relative to said movable plate, in a direction extending transversely to said horizontal direction; and lifting plate drive means operatively connected to said lifting plate for raising and lowering said lifting plate relative to said movable plate, and wherein said mounting means comprises a supporting pin extending from said lifting plate drive means and a bracket mounted to said lifting plate, said bracket having a groove extending therein that is elongate in a direction extending transversely to said horizontial direction, and said pin extending into said bracket within said groove.

2. A screen printing machine for printing a surface of an article with a pattern defined on a screen disposed on the surface, said machine comprising:

a movable plate supported in the machine for reciprocal movement in a horizontal direction;

a lifting plate supported by said movable plate so as to move in the horizontal direction therewith and so as to be raisable and lowerable relative thereto;

a printing member for spreading ink over the surface of an acticle to be printed, said printing member comprising at least one of a skid and a scraper mounted to said movable plate so as to move therewith;

mounting means mounting said lifting plate to said movable plate in a manner which allows said lifting plate to pivot relative to said movable plate and to move horizontally, relative to said movable plate, in a direction extending transversely to said horizontal direction; and lifting plate drive means operatively connected to said lifting plate for raising and lowering said lifting plate relative to said movable plate, and wherein said mounting means comprises a supporting pin extending from said lifting plate and a bracket mounted to said lifting plate drive means, said bracket having a groove extending therein that is elongate in a direction extending transversely to said horizontal direction, and said pin extending into said bracket within said groove.

* * * * *